US008905377B2

(12) United States Patent
Shen et al.

(10) Patent No.: US 8,905,377 B2
(45) Date of Patent: Dec. 9, 2014

(54) BOOM-ADJUSTABLE HORIZONTAL HYDRAULIC JACK WITH A PULL-LOCK MECHANISM

(71) Applicant: Changshu Tongrun Auto Accessory Co., Ltd., Jiangsu (CN)

(72) Inventors: Min Shen, Jiangsu (CN); Xiaoming Shi, Jiangsu (CN)

(73) Assignee: Southeast University, Jiangsu (CN)

( * ) Notice: Subject to any disclaimer, the term of this patent is extended or adjusted under 35 U.S.C. 154(b) by 245 days.

(21) Appl. No.: 13/691,080

(22) Filed: Nov. 30, 2012

(65) Prior Publication Data

US 2013/0153839 A1 Jun. 20, 2013

(30) Foreign Application Priority Data

Dec. 7, 2011 (CN) ..... 2011 1 0403241

(51) Int. Cl.

| | |
|---|---|
| ***B66F 5/02*** | (2006.01) |
| ***B66F 5/04*** | (2006.01) |
| ***B66F 3/24*** | (2006.01) |

(52) U.S. Cl.

CPC ..... *B66F 5/04* (2013.01)
USPC ..... 254/8 B; 254/2 B; 254/93 R

(58) Field of Classification Search

USPC ..... 254/2 B, 1, 2 C, 93 H, 11–17, 122–126, 254/133 R, 93 R, 8 B

See application file for complete search history.

(56) References Cited

U.S. PATENT DOCUMENTS

| | | | | |
|---|---|---|---|---|
| 3,907,252 | A * | 9/1975 | Gaarder | 254/8 B |
| 4,289,298 | A * | 9/1981 | Kameda | 254/8 B |
| 4,513,950 | A * | 4/1985 | Yamagishi | 254/8 B |
| 7,434,782 | B2 * | 10/2008 | Arzouman | 254/8 B |
| 2003/0218159 | A1 * | 11/2003 | Arzouman | 254/8 B |
| 2005/0035337 | A1 * | 2/2005 | Hung | 254/8 B |
| 2008/0083913 | A1 * | 4/2008 | Fang et al. | 254/8 B |

FOREIGN PATENT DOCUMENTS

CN 101691194 A 4/2010

* cited by examiner

*Primary Examiner* — Lee D Wilson
*Assistant Examiner* — Seahee Yoon
(74) *Attorney, Agent, or Firm* — Sunstone IP

(57) ABSTRACT

A boom-adjustable horizontal hydraulic jack with a pull-lock mechanism belongs to a lifting apparatus. The jack comprises a chassis, a hydraulic assembly, a press handle, a boom assembly, and a link rod assembly, wherein, the boom assembly comprises a bearer, a forearm, and a rear arm; the link rod assembly comprises a first link rod and a second link rod; wherein, a pull-lock mechanism is additionally arranged on the bearer, and comprises a guide rod seat, a guide rod, a pull handle, a guide sleeve, a steel rope, a dialing plate shaft, and a locking pin shaft.

5 Claims, 2 Drawing Sheets

BOOM-ADJUSTABLE HORIZONTAL HYDRAULIC JACK WITH A PULL-LOCK MECHANISM

CROSS-REFERENCE TO RELATED APPLICATIONS

This application claims the benefit of Chinese Patent Application No. 201110403241.7, filed on Dec. 7, 2011, which is incorporated herein by reference.

BACKGROUND OF THE INVENTION

1. The Field of the Invention

The present invention pertains to the technical field of lifting apparatuses, and particularly relates to a boom-adjustable horizontal hydraulic jack with a pull-lock mechanism, which is an improvement to the boom structure of the existing horizontal hydraulic jacks.

2. The Relevant Technology

At present, the horizontal hydraulic jacks commonly seen in the market mainly comprise a chassis, a hydraulic assembly, a boom assembly, a link rod, and a press handle, wherein, the boom assembly comprises a boom and a bearer arranged on the boom, one end of the link rod is pivotably connected with the chassis, and the other end of the link rod is pivotably connected with the bearer of the boom assembly. During the lifting process, by pressing the press handle repeatedly, the hydraulic assembly drives the boom assembly to lift up, and finally the bearer on the boom jacks up the weight. The structure described above has the following drawback: for the same kind of horizontal hydraulic jacks, i.e., when the parameters such as oil pressure and stroke are fixed, both the lifting height and the load capacity thereof will be fixed and cannot be changed; therefore, such a horizontal hydraulic jack has single function and limited applicability. To overcome the drawback described above, a new kind of horizontal hydraulic jack has emerged in the market, in which the lifting height and load capacity at the lowest position can be changed effectively by adjusting the length of the boom and the length of the link rod under the condition with the same parameters. For example, in the Chinese Patent Application, submitted by the present applicant on Sep. 16, 2009, with the Publication No. CN101691194A, entitled "Adjustable Horizontal Hydraulic Jack", the boom can be lifted up in folded and normal position statuses, and the switch between the two statuses is accomplished by means of a fixing pin. Such a structure is simple, but the switching operation is troublesome.

In view of the above drawbacks, the applicant has tried and found a solution to solve the above-mentioned technical problems. The technical scheme to be described below is right created in such a background.

BRIEF SUMMARY OF THE INVENTION

The object of the present invention is to provide a boom-adjustable horizontal hydraulic jack with a pull-lock mechanism which has reasonable structure and reliable operation, and are simple and safe to use.

The object of the present invention is achieved as follows: a boom-adjustable horizontal hydraulic jack with a pull-lock mechanism comprises a chassis, a hydraulic assembly, a press handle, a boom assembly, and a link rod assembly, wherein, the boom assembly comprises a bearer, a forearm and a rear arm, the bearer comprises a bearer carrier fixed under the bearer, one end of the forearm is pivotably connected with the bearer carrier via a first pin shaft, the other end of the forearm is pivotably connected with one end of the rear arm via a second pin shaft, and the other end of the rear arm is pivotably connected with the chassis; the link rod assembly comprises a first link rod and a second link rod, one end of the first link rod is pivotably connected with the bearer carrier via a third pin shaft, the other end of the first link rod is pivotably connected with one end of the second link rod via a fourth pin shaft, and the other end of the second link rod is pivotably connected with the chassis; a connecting plate is connected between the fourth pin shaft and the second pin shaft; characterized in that: a pull-lock mechanism is arranged on the bearer carrier of the bearer, and the pull-lock mechanism comprises a guide rod seat, a guide rod, a pull handle, a guide sleeve, a steel rope, a dialing plate shaft, and a locking pin shaft, wherein, the guide rod is fixed on the bearer carrier, the guide rod seat is mounted at one end of the guide rod, the pull handle is arranged on the guide rod in a slideable manner, a pair of first steel rope holes are arranged on the pull handle, the guide sleeve is fixed to the guide rod, both ends of the dialing plate shaft are mounted on the bearer carrier, a first compression spring, a pair of dialing plates, and a pair of sliding sleeves for dialing plate are arranged on the dialing plate shaft respectively; a second steel rope hole is arranged on the pair of dialing plates respectively, a second compression spring is arranged in the middle of the locking pin shaft, locking pins are arranged on both ends of the locking pin shaft in a slideable manner respectively, and a pair of locking pins are arranged in a pair of locking pin holes of the forearms, dialing disks designed to match with the pair of dialing plates are arranged on the inner end of the pair of locking pins, and the outer end of the pair of locking pins are designed to match with the locking holes arranged on the bearer carrier; both ends of the steel rope pass through a pair of first steel rope holes and a pair of second steel rope holes respectively and then are locked tightly by the steel rope adjusting leg; a groove is arranged on the other end of the forearm, and a limit shaft designed to match with the groove is arranged on the rear arm.

In an embodiment of the present invention, bearer carrier fixing cavities are arranged on the bearer, bosses are formed on the upper part of the bearer carrier in the height direction, and the bearer is fixed to the bearer carrier by means of the engagement between the bosses and the bearer carrier fixing cavities.

In another embodiment of the present invention, first shaft holes designed to match with the first pin shaft are arranged on the bearer carrier.

In another embodiment of the present invention, dialing plate shaft holes designed to match with the dialing plate shaft are arranged on the bearer carrier.

In a further embodiment of the present invention, third shaft holes designed to match with the third pin shaft are arranged on the bearer carrier.

With the structure described above, the present invention has the following beneficial effects: when the pull handle is pulled outwards, the steel rope is tensioned up and thereby drives a pair of dialing plates to move towards the center of the dialing plate shaft so as to compress the first compression spring; through the engagement with the dialing disks, the inward movement of the pair of dialing plates drives a pair of locking pins to move together towards the center of the locking pin shaft and compress the second compression spring, so that the outer end of the pair of locking pins disengages from the lock holes of the bearer carrier; at the moment, through the hooked engagement between the grooves of the forearms of the boom assembly and the limit shaft of the rear arm, the boom and the link rod are lifted up in normal position status;

when the guide rod seat is pushed, the forearms of the boom assembly revolve upwards with the second pin shaft serving as the pivot, and the grooves of the forearms disengage from the limit shaft of the rear arm till the forearms almost reach the vertical position; at that position, the pair of locking pins return to their original positions under the action of the restoring force of the second compression spring, so that the outer end of the pair of locking pins are respectively fitted to the corresponding locking holes of the bearer carrier, and thereby the bearer and the forearms are connected fixedly to each other; in that status, the boom and the link rod will be lifted up in folded position status. In summary, with the additional pull-lock mechanism, the boom of the present invention can be switched between folded position status and normal position status quickly; the boom-adjustable horizontal hydraulic jack is easy to operate, reliable to operate, and safe to use, and is suitable for the lifting work of automobiles in different heights.

These and other objects and features of the present invention will become more fully apparent from the following description and appended claims, or may be learned by the practice of the invention as set forth hereinafter.

BRIEF DESCRIPTION OF THE DRAWINGS

To further clarify the above and other advantages and features of the present invention, a more particular description of the invention will be rendered by reference to specific embodiments thereof which are illustrated in the appended drawings. It is appreciated that these drawings depict only illustrated embodiments of the invention and are therefore not to be considered limiting of its scope. The invention will be described and explained with additional specificity and detail through the use of the accompanying drawings in which.

In the figures: 1. hydraulic assembly; 2. chassis; 3. boom assembly, 31. bearer, 311. bearer carrier fixing cavity, 312. bearer carrier, 3121. boss, 3122. first shaft hole, 3123. locking hole, 3124. dialing plate shaft hole, 3125. third shaft hole, 32. forearm, 321. locking pin hole, 322. first pin shaft, 323. second shaft hole, 324. groove, 33. rear arm, 331. limit shaft, 332. second pin shaft; 4. press handle; 5. link rod assembly, 51. first link rod, 511. fourth shaft hole, 52. third pin shaft, 53. fourth pin shaft, 54. second link rod; 6. connecting plate; 7. pull-lock mechanism, 71. guide rod seat, 72. guide rod, 73. pull handle, 731. first steel rope hole, 74. guide sleeve, 75. steel rope, 751. steel rope adjusting leg, 76. dialing plate shaft, 761. first compression spring, 762. dialing plate, 7621. second steel rope hole, 763. dialing plate slide sleeve, 77. locking pin shaft, 771. locking pin, 7711. dialing disk, 772. second compression spring.

DETAILED DESCRIPTION OF THE PREFERRED EMBODIMENTS

In order to help the examiners of the Patent Office and especially the public to understand the technical essence and beneficial effects of the present invention more clearly, hereunder the applicant will describe the embodiments of the present invention in details with reference to the accompanying drawings. However, the description of the embodiments shall not be deemed as limitation to the technical scheme of the present invention. Any equivalent but insubstantial modification or variation made without departing from the concept and spirit of the present invention shall be deemed as falling into the protected scope of the present invention.

Figure 1:
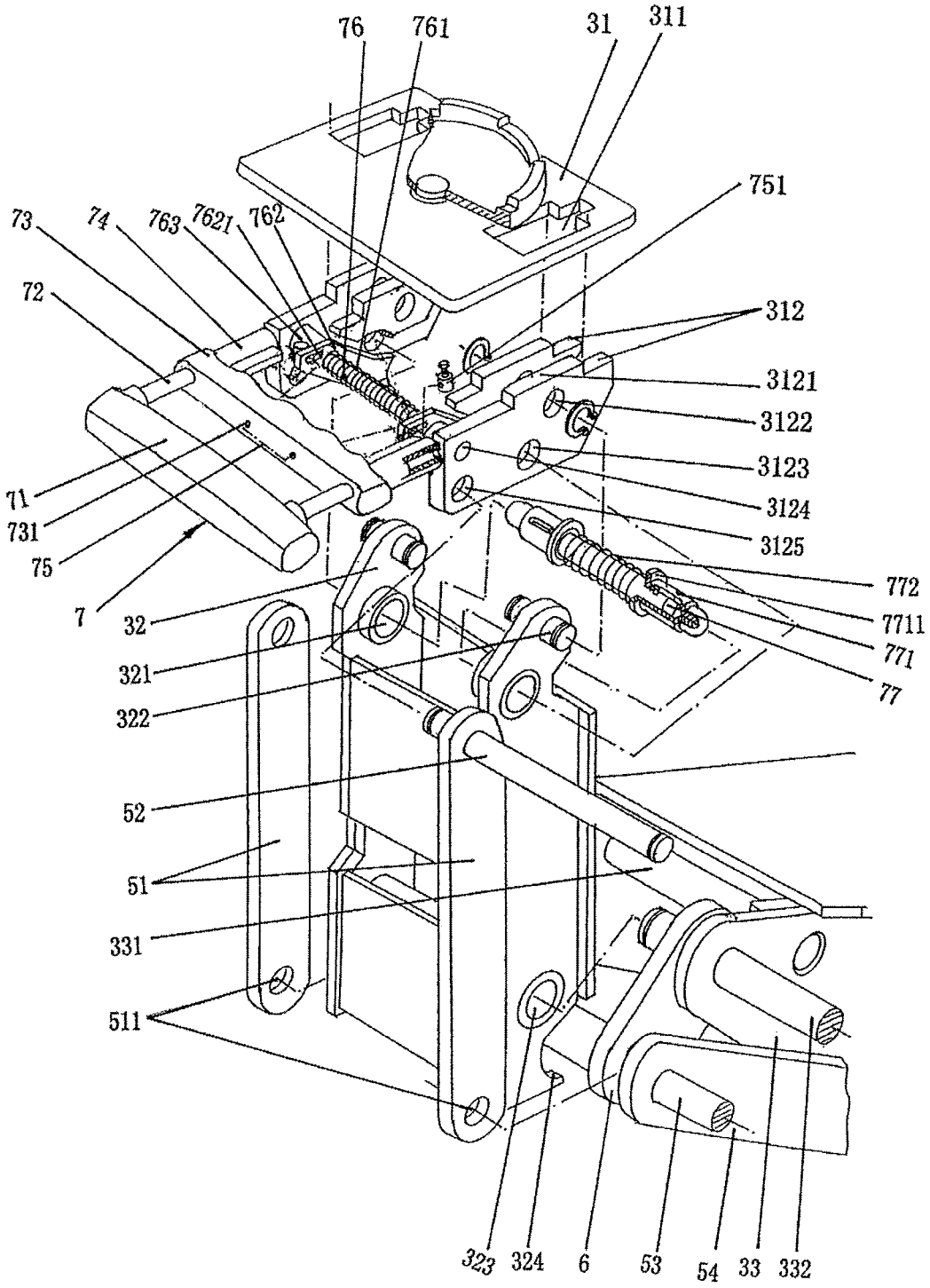
FIG. 1 is an exploded perspective view of an embodiment of the present invention.
Figure 2:
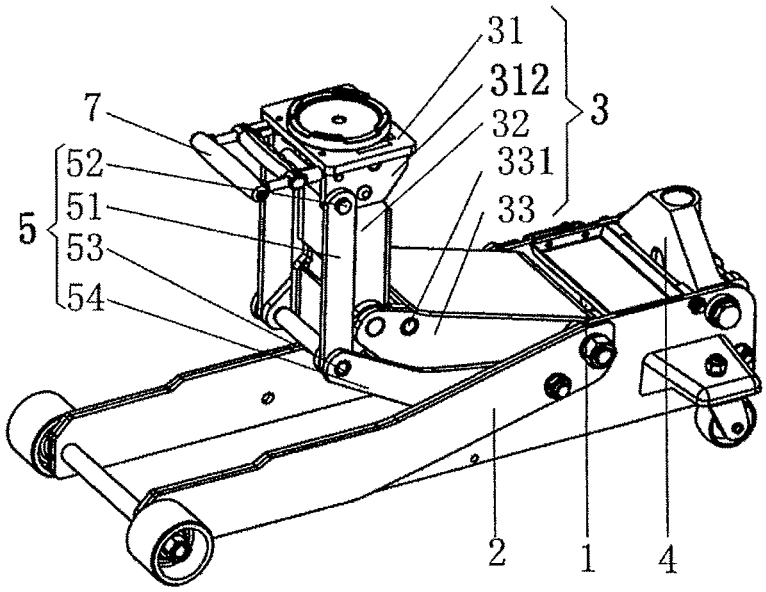
FIG. 2 is a perspective view of an embodiment of the present invention, with the boom lifted in folded position status.
Figure 3:
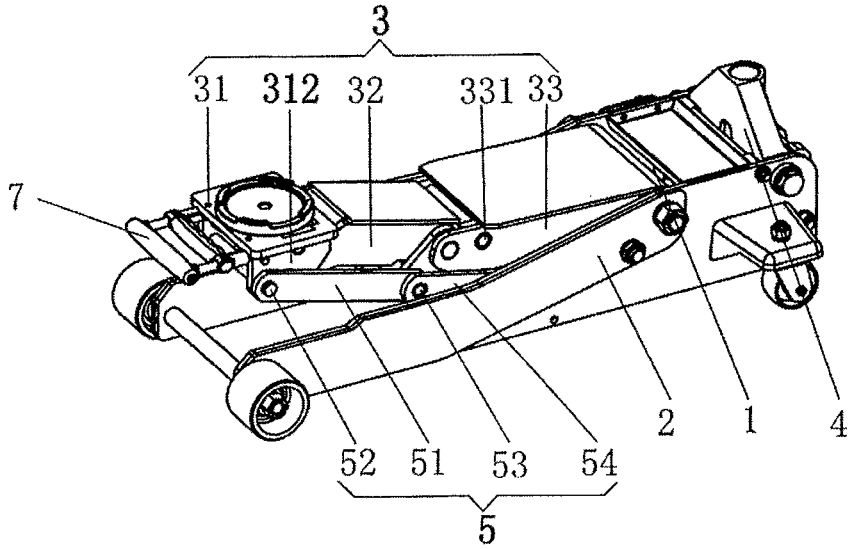
FIG. 3 is a perspective view of an embodiment of the present invention, with the boom lifted in normal position status.

Please see FIG. 1 with reference to FIG. 2 and FIG. 3. A boom-adjustable horizontal hydraulic jack with a pull-lock mechanism of the present invention comprises a chassis 2, a hydraulic assembly 1, a press handle 4, a boom assembly 3, a link rod assembly 5, and a pull-lock mechanism 7. The boom assembly 3 comprises a bearer 31, a forearm 32, and a rear arm 33, wherein, the bearer 31 comprises a bearer carrier 312 fixed under the bearer 31, the bearer carrier 312 is present in pairs, which have a boss 3121, a first shaft hole 3122, a locking hole 3123, a dialing plate shaft hole 3124, and a third shaft hole 3125 respectively, and the pair of bearer carriers 312 are fixed under the bearer 31 via the bosses 3121.

The forearm 32 is also present in pairs, which have a first pin shaft 322 and a locking pin hole 321 on one end respectively, and have a second shaft hole 323 and a groove 324 on the other end respectively; one end of the pair of forearms 32 are pivotably connected with the corresponding first shaft hole 3122 of the pair of bearer carriers 312 via the first pin shaft 322 and fixed by a snap spring on the outside respectively, the other end of the pair of forearms 32 are pivotably connected with the corresponding second pin shaft 332 of the pair of rear arms 33 via the second shaft hole 323 respectively, and the other end of the pair of rear arms 33 are pivotably connected with the chassis 2 respectively.

The link rod assembly 5 comprises a first link rod 51 and a second link rod 54, wherein, the first link rod 51 and second link rod 54 are present in pairs respectively, a third pin shaft 52 is mounted between one ends of the pair of first link rods 51, a fourth shaft hole 511 is arranged on the other ends of the pair of first link rods 51 respectively, one end of the pair of first link rods 51 are pivotably connected with the third shaft holes 3125 of the bearer carrier 312 via the third pin shaft 52, the other end of the pair of first link rods 51 are pivotably connected with a fourth pin shaft 53 on one end of the pair of second link rods 54 via the fourth shaft holes 511, the other end of the pair of second link rods 54 are pivotably connected with the chassis 2 respectively, a pair of connecting plates 6 are connected between the fourth pin shaft 53 and the second pin shaft 332.

The pull-lock mechanism 7 comprises a guide rod seat 71, a guide rod 72, a pull handle 73, a guide sleeve 74, a steel rope 75, a dialing plate shaft 76, and a locking pin shaft 77, wherein, the guide rod 72 is present in pairs which are fixed to the pair of bearer carriers 312 respectively, the guide rod seat 71 is connected between the ends of the pair of guide rods 72, the pull handle 73 is arranged on the pair of guide rods 72 in a slideable manner, a pair of first steel rope holes 731 are arranged on the pull handle 73, the guide sleeve 74 is present in pairs which are fixed to the pair of guide rods 72 respectively, but alternatively, the guide sleeve 74 can be integrated with the guide rod 72, the two ends of the dialing plate shaft 76 are mounted in the corresponding dialing plate shaft holes 3124 of the pair of bearer carriers 312, a first compression spring 761, a pair of dialing plates 762 and a pair of dialing plate slide sleeves 763 are arranged on the dialing plate shaft 76 respectively, and the pair of dialing plates 762 are located at the outside of the first compression spring 761 respectively, the pair of dialing plate slide sleeves 763 are located at the outside of the pair of dialing plates 762 respectively, a second steel rope hole 7621 is arranged on the pair of dialing plates 762 respectively, a second compression spring 772 is arranged in the middle of the locking pin shaft 77, locking pins 771 are arranged on the two ends of the locking pin shaft 77 in a slideable manner respectively, a pair of locking pins 771 are inserted in the locking pin holes 321 of the pair of forearms 3, dialing disks 7711 designed to match with the pair of dialing plates 762 are arranged on the inner end of the pair of locking pins 771, the outer end of the pair of locking pin 771 are designed to match with the locking holes 3123 on the pair of bearer carriers 312; the two ends of the steel rope 75 pass through the pair of first steel rope holes 731 and the pair of second steel rope holes 7621 respectively and then are locked by steel rope adjusting leg 751.

Example 1

Please see FIG. 2, with reference to FIG. 1. When the forearms 32 of the boom assembly 3 and first link rod 51 are lifted up in folded position status, the guide rod seat 71 is pushed, so that the forearms 32 of the boom assembly 3 revolve upwards with the second pin shaft 332 as the pivot, the grooves 324 of the forearms 32 disengages from the hooked engagement with the limit shaft 331 of the rear arm 33 till the forearms 32 almost reach the vertical position; at that position, the pair of locking pins 771 return to their original positions under the action of the restoring force of the second compression spring 772, so that the outer end of the pair of locking pins 771 are fitted to the corresponding locking holes 3123 on the bearer carrier 312, and thereby the bearer 31 and the forearms 32 are connected fixedly to each other; that status is the folded position status of the forearms 32 of the boom assembly 3 and the first link rod 51. When the lifting should be performed in folded status, the forearms 32 revolve around the second pin shaft 332, so that the connecting plate 6 drives the first link rod 51 to fold a certain degree around the fourth pin shaft 53 (as shown in FIG. 2); then, as the press handle 4 is pressed repeatedly, the hydraulic assembly 1 pushes the boom assembly 3 to lift up, and finally the bearer 31 jacks up the weight.

With the structure described above, under the condition of the same parameters, the horizontal hydraulic jack provided in the present invention can jack up the automobiles with a heavy load and a high chassis, such as SUV cars or pickup trucks, etc., when the forearms 32 of the boom assembly 3 and the first link rod 51 are lifted up in folded position status.

Example 2

Please see FIG. 3, with reference to FIG. 1. When the forearms 32 of the boom assembly 3 and the first link rod 51 are lifted up in normal position status, the pull handle 73 of the pull-lock mechanism 7 should be pulled outwards, so that the steel rope 75 is tensioned up and drives the pair of dialing plates 762 to move towards the center of the dialing plate shaft 76 and compress the first compression spring 761; the inward movement of the pair of the dialing plates 762, in conjunction with the engagement with the dialing disks 7711 on the pair of locking pins 771, drives the pair of locking pins 771 to move together towards the center of the locking pin shaft 77 and compress the second compression spring 772, so that the outer ends of the pair of locking pins 771 disengage from the connection with the locking holes 3123 on the pair of bearer carriers 312; at the moment, the boom and the link rod are kept in normal position status by means of the hooked engagement between the grooves 324 on the forearms 32 of boom assembly 3 and the limit shaft 331 on the rear arm 33. When the boom and the link rod are lifted up in normal position status, the forearms 32 and rear arms 33 cannot be folded because of the hooked engagement between the grooves 324 and the limit shaft 331; at that position, as the press handle 5 is pressed repeatedly, the hydraulic assembly 1 pushes the boom assembly 3 to lift up, and finally the bearer 31 jacks up the heavy load. In the normal position status, the horizontal hydraulic jack provided in the present invention can be used to jack up the automobiles with a light load and a low chassis, such as sedan cars, etc.

In summary, the technical scheme provided in the present invention has overcame the drawbacks in the prior art and achieved the object of the invention, and has non-obvious technical effects.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A boom-adjustable horizontal hydraulic jack with a pull-lock mechanism, comprising a chassis, a hydraulic assembly, a press handle, a boom assembly, and a link rod assembly, wherein, the boom assembly comprises a bearer, a forearm, and a rear arm, the bearer comprises a bearer carrier fixed under the bearer, one end of the forearm is pivotably connected with the bearer carrier via a first pin shaft, the other end of the forearm is pivotably connected with one end of the rear arm via a second pin shaft, and the other end of the rear arm is pivotably connected with the chassis; the link rod assembly comprises a first link rod and a second link rod, one end of the first link rod is pivotably connected with the bearer carrier via a third pin shaft, the other end of the first link rod is pivotably connected with one end of the second link rod via a fourth pin shaft, and the other end of the second link rod is pivotably connected with the chassis, a connecting plate is connected between the fourth pin shaft and the second pin shaft; characterized in that: a pull-lock mechanism is arranged on the bearer carrier of the bearer, and the pull-lock mechanism comprises a guide rod seat, a guide rod, a pull handle, a guide sleeve, a steel rope, a dialing plate shaft, and a locking pin shaft, wherein, the guide rod is fixed to the bearer carrier, the guide rod seat is mounted at the ends of the guide rod, the pull handle is arranged on the guide rod in a slideable manner, a pair of first steel rope holes are arranged on the pull handle, the guide sleeve is fixed to the guide rod, both ends of the dialing plate shaft are mounted on the bearer carrier, a first compression spring, a pair of dialing plates and a pair of dialing plate slide sleeves are arranged on the dialing plate shaft, second steel rope holes are arranged on the pair of dialing plates respectively, a second compression spring is arranged in the middle of the locking pin shaft, locking pins are arranged on each end of the locking pin shaft in a slideable manner respectively, and the pair of lock pins are arranged in a pair of locking pin holes of the forearms, and dialing disks designed to match with the pair of dialing plates are arranged on the inner end of the pair of locking pins, and the outer end of the pair of locking pins are designed to match with locking holes arranged on the bearer carrier, both ends of the steel rope pass through the pair of first steel rope holes and the pair of second steel rope holes respectively and then are locked by steel rope adjusting legs; a groove is arranged on the other end of the forearm, and a limit shaft designed to match with the groove is arranged on the rear arm.

2. The boom-adjustable horizontal hydraulic jack with a pull-lock mechanism according to claim 1, wherein, bearer carrier fixing cavities are arranged on the bearer, and bosses are formed on the upper part of the bearer carrier in the height direction, and the bearer is fixed to the bearer carrier by means of the engagement between the bosses and the bearer carrier fixing cavities.

3. The boom-adjustable horizontal hydraulic jack with a pull-lock mechanism according to claim 1, wherein, first shaft holes designed to match with the first pin shaft are arranged on the bearer carrier.

4. The boom-adjustable horizontal hydraulic jack with a pull-lock mechanism according to claim 1, wherein, dialing plate shaft holes designed to match with the dialing plate shaft are arranged on the bearer carrier.

5. The boom-adjustable horizontal hydraulic jack with a pull-lock mechanism according to claim 1, wherein, third shaft holes designed to match with the third pin shaft are arranged on the bearer carrier.

* * * * *

UNITED STATES PATENT AND TRADEMARK OFFICE

CERTIFICATE OF CORRECTION

PATENT NO. : 8,905,377 B2
APPLICATION NO. : 13/691080
DATED : December 9, 2014
INVENTOR(S) : Min Shen and Xiaoming Shi It is certified that error appears in the above-identified patent and that said Letters Patent is hereby corrected as shown below:

Title page, item 73 Assignee: should read as follows:

Changshu Tongrun Auto Accessory Co., Ltd. Jiangsu (CN)

Signed and Sealed this
Seventeenth Day of November, 2015

Michelle K. Lee

Michelle K. Lee
*Director of the United States Patent and Trademark Office*